US011660653B2

(12) United States Patent
Han et al.

(10) Patent No.: US 11,660,653 B2
(45) Date of Patent: May 30, 2023

(54) ULTRA-LOW PRESSURE LIQUID FILLING FORMING SYSTEM AND METHOD FOR SPECIAL-SHAPED COMPONENT

(71) Applicant: Harbin Institute of Technology, Harbin (CN)

(72) Inventors: Cong Han, Harbin (CN); Shijian Yuan, Harbin (CN); Xiaolei Cui, Harbin (CN)

(73) Assignee: HARBIN INSTITUTE OF TECHNOLOGY, Harbin (CN)

( * ) Notice: Subject to any disclaimer, the term of this patent is extended or adjusted under 35 U.S.C. 154(b) by 0 days.

(21) Appl. No.: 17/339,460

(22) Filed: Jun. 4, 2021

(65) Prior Publication Data

US 2022/0055086 A1 Feb. 24, 2022

(30) Foreign Application Priority Data

Aug. 19, 2020 (CN) ..... 202010836089.0

(51) Int. Cl.
*B21D 26/00* (2006.01)
*B21D 26/041* (2011.01)

(52) U.S. Cl.
CPC ..... *B21D 26/041* (2013.01)

(58) Field of Classification Search
CPC .. B21D 26/033; B21D 26/035; B21D 26/039; B21D 26/047; B21D 26/041
See application file for complete search history.

(56) References Cited

U.S. PATENT DOCUMENTS

2019/0126714 A1* 5/2019 Wada ..... B21D 53/88

FOREIGN PATENT DOCUMENTS

CN 106881394 A 6/2017

* cited by examiner

*Primary Examiner* — Debra M Sullivan
(74) *Attorney, Agent, or Firm* — Hayes Soloway PC

(57) ABSTRACT

The present disclosure discloses an ultra-low pressure liquid filling forming system for a special-shaped component, including a control system, a supercharger, a driving device, a preforming unit, and a final forming unit. The present disclosure further provides an ultra-low pressure liquid filling forming method for a special-shaped component, including the following steps: S1: making an equal diameter cylindrical coil blank with an overlapping part in a longitudinal direction by using a plate blank; S2: bulging the equal diameter cylindrical coil blank into a variable diameter cylindrical prefabricated coil blank; S3: cutting and welding the overlapping part remaining on the variable diameter cylindrical prefabricated coil blank in the axial direction to obtain a variable diameter prefabricated tube blank; S4: filling liquid and press-forming the variable diameter prefabricated tube blank, so that the variable diameter prefabricated tube blank occurs compressive deformation, thereby forming the special-shaped component.

20 Claims, 10 Drawing Sheets

ULTRA-LOW PRESSURE LIQUID FILLING FORMING SYSTEM AND METHOD FOR SPECIAL-SHAPED COMPONENT

CROSS REFERENCE TO RELATED APPLICATIONS

This patent application claims the benefit and priority of Chinese Patent Application No. 202010836089.0, filed on Aug. 19, 2020, the disclosure of which is incorporated by reference herein in its entirety as part of the present application.

TECHNICAL FIELD

The present disclosure relates to the technical field of metal forming and manufacturing, and in particular, to an ultra-low pressure liquid filling forming system and method for a special-shaped component.

BACKGROUND ART

With continuous development of high-tech industries such as automobiles, aviation and aerospace, more stringent requirements are being put forward for lightweight, integration, high performance, and high reliability of structures. Not only the overall reliability of the structure is ensured, but also the weight being as light as possible is ensured on the basis of meeting the strength requirement. High-precision shape and size and excellent performance are achieved on the premise of meeting the structural requirement. As a type of typical structure, special-shaped thin-walled metal tube components often have the characteristics of complex tube shapes, large diameter-to-thickness ratios, large cross-sectional differences, high material strength and the like, and have a lot of application requirements in the fields of new-generation automobiles, as well as in the fields of aviation and aerospace. The special-shaped thin-walled tube components made of high-strength materials, such as integral structural high-strength steel, titanium alloys, and high-temperature alloys, have especially good mechanical properties and corrosion resistance, and are ideal hollow integral structures that have a good application prospect. In industrial production, there are mainly two types of forming methods for the special-shaped thin-walled components, namely "blocking+welding" and internal high pressure forming.

By the "blocking+welding" method, an envelope is formed in a stretching or blowdown mode, and then a special-shaped thin-walled component is formed by assembling and butt-welding. This method leads to several problems. The spatial assembly difficulty is great, the thermal deformation is serious after welding, and the use precision can be achieved through long-time high-temperature creep shaping. Additionally, the crisscross welding seams reduce the service reliability, the process chain is long, the process controllability is poor, and the product quality consistency is poor.

By the internal high pressure forming method, a tube is taken as a blank and the tube is pressed into a mold cavity of a die to form a workpiece in a desired shape by applying a high-pressure liquid and axially supplementing a material into the tube. A hollow component with a special-shaped cross section is integrally formed by taking a flexible liquid as a soft die. The liquid pressure is easy to control, the process is implemented at room temperature, and the processability is good. Internal pressure is the main driving force for the deformation of the tube blank, so the pressure required by the internal high pressure forming is very high. For example, for a common low-carbon steel material, the shaping pressure is up to 200 MPa for forming a fillet of about 5 mm. The pressure has very high requirements on sealing, hydraulic components, die strength, press tonnage and the like, which restricts further application of the technology on a high-strength material and a product with a large cross-sectional size and large cross-sectional difference. The forming pressure required by the high-strength material exceeds 400 MPa, and exceeds the highest pressure limit of engineering equipment. The formed maximum diameter is less than 200 mm and the cross-sectional difference is less than 50%. Excessive size will lead to a sharp increase of equipment tonnage. Excessive cross-sectional difference will lead to serious wall thickness thinning of a formed piece. In addition, the transition of the fillet is thinned easily to cause uneven wall thickness, and even cracking.

In order to solve the problem of high pressure, one company proposed low pressure sequential forming. The internal pressure is increased when a die is closed, so that the tube blank is partially deformed to reduce the deformation amount in a shaping stage. Correspondingly, the required shaping pressure is reduced by 30% to 50%. But in practice, it is found that the processability of the technology is poor. Firstly, expansive deformation during die closing is not easy to control. A dead wrinkle will be formed if the expansive deformation is excessive, and the shaping pressure is still very high if the expansive deformation is too small. Secondly, a compression effect is achieved on the liquid in a tube cavity by die closing, which leads to the fluctuation of the internal pressure and interferes with the precise control of pressure by the hydraulic components, so extremely high requirements are proposed on the feedback and response of equipment.

Yuan Shijian of Harbin Institute of Technology proposed a concave preforming technology. First, a tube blank is pressed into a concave shape. The shape will produce a horizontal pushing force that is magnified several times under the action of internal pressure so as to push the blank of a concave section to a fillet, which ingeniously reduces the forming pressure. However, the concave preforming technology is mainly applied in an early stage of forming. The horizontal pushing force does not exist after a concave is flattened, so it is still necessary to increase the pressure to make a non-attached area attach to a die.

A German scholar proposed a hot-gas bulging forming technology, which achieves a purpose of reducing a forming pressure by reducing the flow stress of a material through heating. However, the problems of further increasing a friction coefficient and further reducing a hardening index under a high temperature are caused, so the wall thickness uniformity of the formed piece is not good. There are also problems relating to structure performance control, surface quality and the like in high temperature forming. In addition, in a high-temperature environment, the generation, control, sealing and the like of the pressure are inconvenient to implement.

In conclusion, the development of the current technology has higher requirements on the special-shaped thin-walled components. The existing technologies at home and abroad propose a variety of improvement methods for the special-shaped thin-walled components based on an "expansive deformation idea", which cannot meet the overall forming requirements of the special-shaped thin-walled components with large diameter-to-thickness ratios, large section difference and high-precision.

SUMMARY

The objective of the present disclosure is to provide an ultra-low pressure liquid filling forming system and method for a special-shaped component, so as to solve the above-identified problems and improve the performance and the forming precision of the special-shaped component.

In order to achieve the above-mentioned objective, the present disclosure provides the following solutions:

The present disclosure provides an ultra-low pressure liquid filling forming system for a special-shaped component, which may include a control system, a supercharger, a driving device, a preforming unit, and a final forming unit. The preforming unit may include a preforming die and a self-sealing liquid bag. The final forming unit may include a liquid filling press-forming die and two tube end self-sealing devices. The tube end self-sealing device may include a tube end self-sealing punch and an oil cylinder used for driving the tube end self-sealing punch. The driving device may drive the preforming die and the liquid filling press-forming die to close and open. The driving device and the supercharger may be separately and electrically connected to the control system. One of the tube end self-sealing punches may be provided with a liquid through pipe. The liquid through pipe and the self-sealing liquid bag may be separately in communication with a liquid outlet of the supercharger.

The shape and size of a mold cavity of the preforming die may be matched with the shape and size of a variable diameter cylindrical prefabricated coil blank. The shape and size of a mold cavity of the liquid filling press-forming die may be matched with the shape and size of the special-shaped component.

A coil blank arranged in the mold cavity of the preforming die may be bulged into the variable diameter cylindrical prefabricated coil blank by filling a high-pressure liquid into the self-sealing liquid bag through the supercharger. The high-pressure liquid may be filled into the variable diameter cylindrical prefabricated coil blank arranged in the mold cavity of the liquid filling press-forming die through the supercharger and the liquid through pipe.

The ultra-low pressure liquid filling forming system for a special-shaped component may further include a recovery unit. The recovery unit may include a collection cover, a sedimentation tank, a liquid recovery pump, a filter, a water tank, and a safety valve. The collection cover may be arranged below the liquid filling press-forming die. The sedimentation tank may be arranged below the collection cover. The liquid collected by the collection cover may flow into the sedimentation tank. The sedimentation tank may be in communication with the water tank through a connecting pipe. The liquid recovery pump and the filter may be separately arranged on the connecting pipe, and the filter may be closer to the water tank than the liquid recovery pump. The safety valve may be arranged at the top of the sedimentation tank and may be electrically connected to the supercharger. When the liquid in the sedimentation tank reaches a set height, the safety valve may be triggered and close the connecting pipeline between the supercharger and the liquid through pipe.

The ultra-low pressure liquid filling forming system for a special-shaped component may further include a constant pressure unit. The constant pressure unit may include an energy accumulator, a three-way valve, a liquid inlet hydraulic pump, a one-way valve, and a pressure sensor arranged in the supercharger that may be separately and electrically connected to the control system. A liquid inlet of the liquid inlet hydraulic pump may be in communication with the water tank. A liquid outlet of the liquid inlet hydraulic pump may be in communication with the supercharger. The one-way valve may be arranged on a pipeline between the liquid inlet hydraulic pump and the supercharger. A first end of the three-way valve may be in communication with the energy accumulator. A second end of the three-way valve may be in communication with a pipeline between the one-way valve and the supercharger. A third end of the three-way valve may be in communication with the water tank.

The present disclosure further provides an ultra-low pressure liquid filling forming method for a special-shaped component, based on the ultra-low pressure liquid filling forming system for a special-shaped component, including the following steps:

S1: making an equal diameter cylindrical coil blank with an overlapping part in a longitudinal direction by using a plate blank, where two ends of the plate blank may be overlapped at the overlapping part.

S2: arranging the equal diameter cylindrical coil blank in a mold cavity of a preforming die, bulging the equal diameter cylindrical coil blank with a low-pressure hydraulic force through a self-sealing liquid bag, and making the equal diameter cylindrical coil blank deform into a variable diameter cylindrical prefabricated coil blank, where the perimeter of the variable diameter cylindrical prefabricated coil blank may be equal to that of the cross section of the special-shaped component.

S3: cutting and welding the overlapping part remaining on the variable diameter cylindrical prefabricated coil blank in the axial direction to obtain a variable diameter prefabricated tube blank with the perimeter equal to that of the cross section of the special-shaped component.

S4: arranging the variable diameter prefabricated tube blank in a mold cavity of a liquid filling press-forming die, filling a high-pressure liquid into a tube cavity of the variable diameter prefabricated tube blank through a supercharger to apply a supporting force to the tube cavity, and then applying compressive deformation on the variable diameter prefabricated tube blank through the liquid filling press-forming die, so as to form the special-shaped component.

In S1, the special-shaped component needing to be formed may need to be unfolded by using numerical simulation software. The shape and size of the required plate blank may be determined according to the shape and size of the unfolded special-shaped component, and then, the plate blank may be made into the equal diameter cylindrical coil blank through a bending forming process.

In S2, first, the equal diameter cylindrical coil blank may be placed in a lower die of the preforming die. The self-sealing liquid bag may be arranged into the equal diameter cylindrical coil blank. Two ends of the equal diameter cylindrical coil blank may be axially limited through baffle plates at two ends of the lower die of the preforming die, and then an upper die of the preforming die may be driven to move downwards through the driving device so that the preforming die may be closed. The driving device may be controlled, through the control system, to apply a proper die closing force to the preforming die. A liquid medium may be introduced into the self-sealing liquid bag through the supercharger. The supercharger may be controlled to gradually increase the pressure inside the self-sealing liquid bag and ensure that the applied pressure is lower than the yield pressure of the equal diameter cylindrical coil blank, but is enough to overcome the frictional force between adjacent plate blanks at the overlapping part of the equal diameter cylindrical coil blank. Then, the overlapping part of the equal diameter cylindrical coil blank may be unfolded along with the expansive deformation of the self-sealing liquid bag. Finally, the variable diameter cylindrical prefabricated coil blank may be obtained.

In S3, the overlapping part remaining on the variable diameter cylindrical prefabricated coil blank may be cut from an upper layer and a lower layer, a leftover material of the overlapping part may be removed, and welding may be performed along a cutting line.

In S4, first, the variable diameter prefabricated tube blank may be placed in a lower die of the liquid filling press-forming die. Two oil cylinders may be controlled, through the control system, to drive corresponding self-sealing punches to move inwards along the variable diameter prefabricated tube blank so as to seal two ends of the variable diameter prefabricated tube blank. The high-pressure liquid may be introduced into the variable diameter prefabricated tube blank through the supercharger and the liquid through pipe, and the applied pressure may be ensured to be lower than the yield pressure of the variable diameter prefabricated tube blank. The driving device may be controlled, through the control system, to drive an upper die of the liquid filling press-forming die to move downwards to close the liquid filling press-forming die. During the process, the pressure of the liquid in the variable diameter prefabricated tube blank may be ensured to be unchanged, and the variable diameter prefabricated tube blank may be pressed into a mold cavity of the liquid filling press-forming die under the pressing action of the upper die of the liquid filling press-forming die and the supporting action of the high-pressure liquid in the variable diameter prefabricated tube blank. The variable diameter prefabricated tube blank may be pressed continuously after completely filling the mold cavity of the liquid filling press-forming die so that the variable diameter prefabricated tube blank experiences compressive deformation along the circumferential direction. During the process, the perimeter of the variable diameter prefabricated tube blank may be decreased, and the wall thickness may be increased. Finally, the special-shaped component may be obtained.

Compared with other methods known in the art, the present disclosure achieves the following technical effects:

The ultra-low pressure liquid filling forming system and method for the special-shaped component of the present disclosure improve the performance, the forming precision and the forming efficiency of the special-shaped component. The ultra-low pressure liquid filling forming system and method for the special-shaped component of the present disclosure replace "closing" with "opening", replace the conventional closed tube blank with an open coil blank, realize circumferential distribution of a material, and obtain a formed prefabricated blank with nearly equal wall thickness. Additionally, the present disclosure replaces "expansion" with "compression", and replaces "expansive" deformation in the conventional internal high pressure forming with "compressive" deformation in liquid filling press-forming. Compared with the conventional internal high pressure forming method, the sensitivity of the present disclosure to the material is greatly reduced, which is more suitable for the forming of a high-strength and low-plasticity material. Meanwhile, the present disclosure has the advantages of improving the shape and size precision of a product, improving the wall thickness distribution of the product, remarkably reducing the forming pressure and the tonnage of a die closing press, reducing the production cost and the like.

BRIEF DESCRIPTION OF THE DRAWINGS

In order to describe the technical solutions in the embodiments of the present disclosure or in the prior art more clearly, the following briefly describes the accompanying drawings required for describing the embodiments or the prior art. The accompanying drawings in the following description are merely some embodiments of the present disclosure, and those of ordinary skill in the art may derive other drawings from these accompanying drawings without creative efforts.

Figure 1:
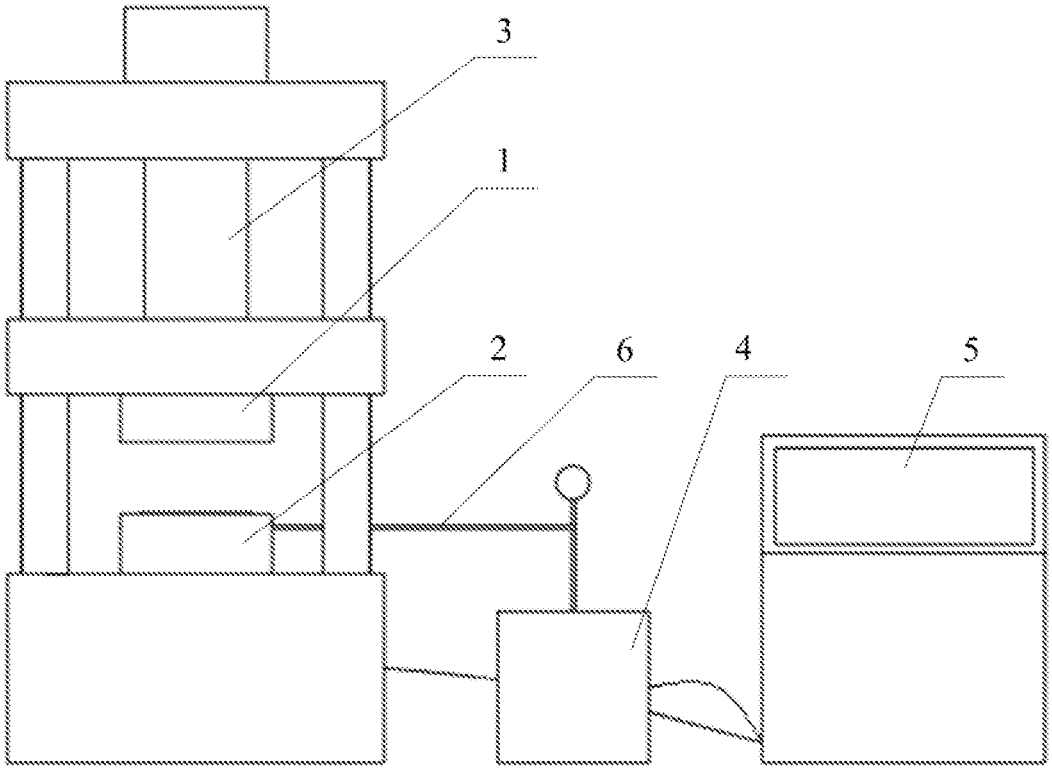
FIG. 1 is a structural schematic diagram of an ultra-low pressure liquid filling forming system for a special-shaped component of the present disclosure.

In the drawings, the following reference numerals correspond to the following elements: 1—upper die of preforming die; 2—lower die of preforming die; 3—driving device; 4—supercharger; 5—control system; 6—liquid through pipe; 7—self-sealing liquid bag; 8—equal diameter cylindrical coil blank; 9—variable diameter cylindrical prefabricated coil blank; 10—variable diameter prefabricated tube blank; 11—upper die of liquid filling press-forming die; 12—lower die of liquid filling press-forming die; 13—left oil cylinder; 14—right oil cylinder; 15—left tube end self-sealing punch; 16—right tube end self-sealing punch; 17—constant pressure unit; 18—special-shaped component; 19—energy accumulator; 20—three-way valve; 20A—first end of the three-way valve; 20B—second end of the three-way valve; 20C—third end; 21—liquid inlet hydraulic pump; 21A—liquid inlet of the liquid inlet hydraulic pump; 22—water tank; 23—one-way valve; 24—pressure sensor; 25—liquid recovery pump; 26—sedimentation tank; 27—filter; 28—connecting pipe; 29-preforming unit; 30-final forming unit; 31-preforming die; and 32-liquid filling press-forming die.

DETAILED DESCRIPTION OF THE EMBODIMENTS

The technical solutions in the embodiments of the present disclosure will be clearly and completely described herein below with reference to the accompanying drawings in the embodiments of the present disclosure. The described embodiments are merely part rather than all of the embodiments of the present disclosure. On the basis of the embodiments of the present disclosure, all other embodiments obtained by those of ordinary skill in the art without creative work fall within the scope of protection of the present disclosure.

The objective of the present disclosure is to provide an ultra-low pressure liquid filling forming system and method for a special-shaped component, so as to solve the above-mentioned problems and improve the performance and the forming precision of the special-shaped component.

In order to make the above objective, features, and advantages of the present disclosure become more apparent and more comprehensible, the present disclosure is further described in detail below with reference to the accompanying drawings and specific implementation manners.

Figure 2:
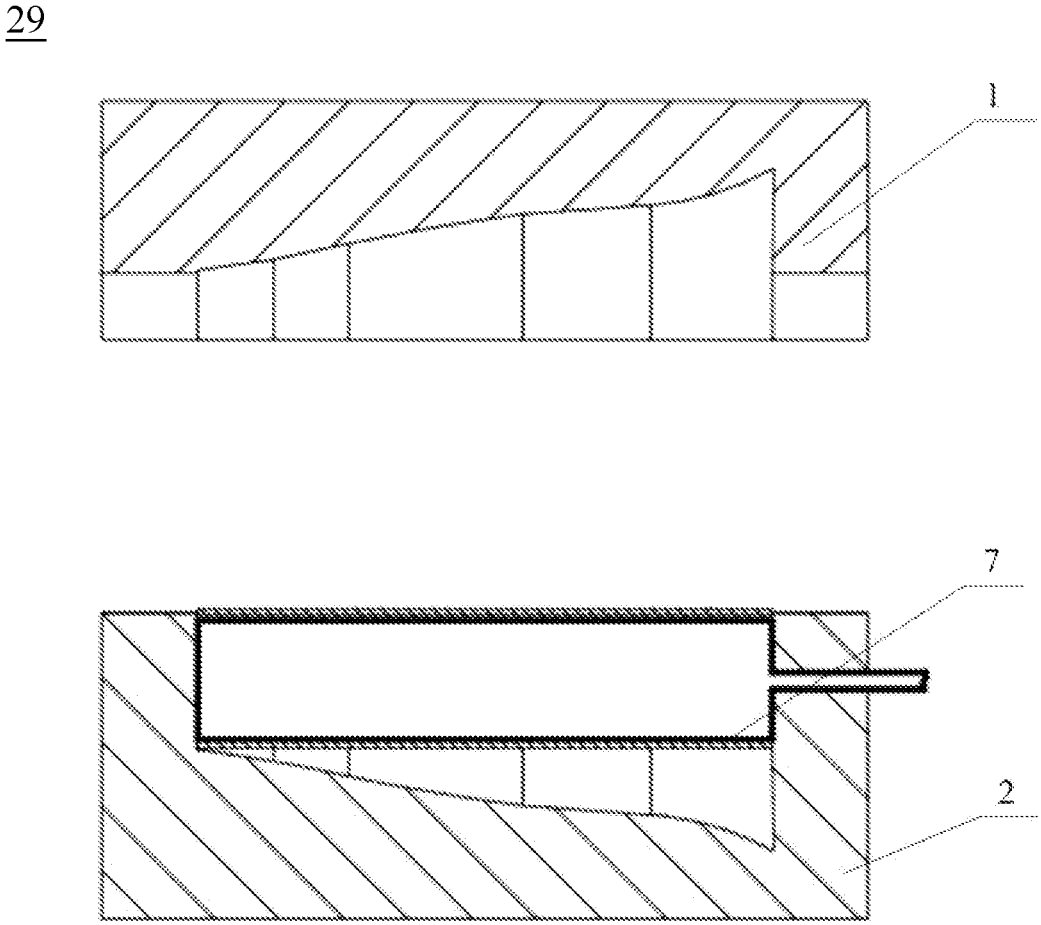
FIG. 2 is a schematic diagram of a positional relationship between a die and a tube blank in a preforming initial stage of the ultra-low pressure liquid filling forming system for a special-shaped component of the present disclosure.
Figure 3:
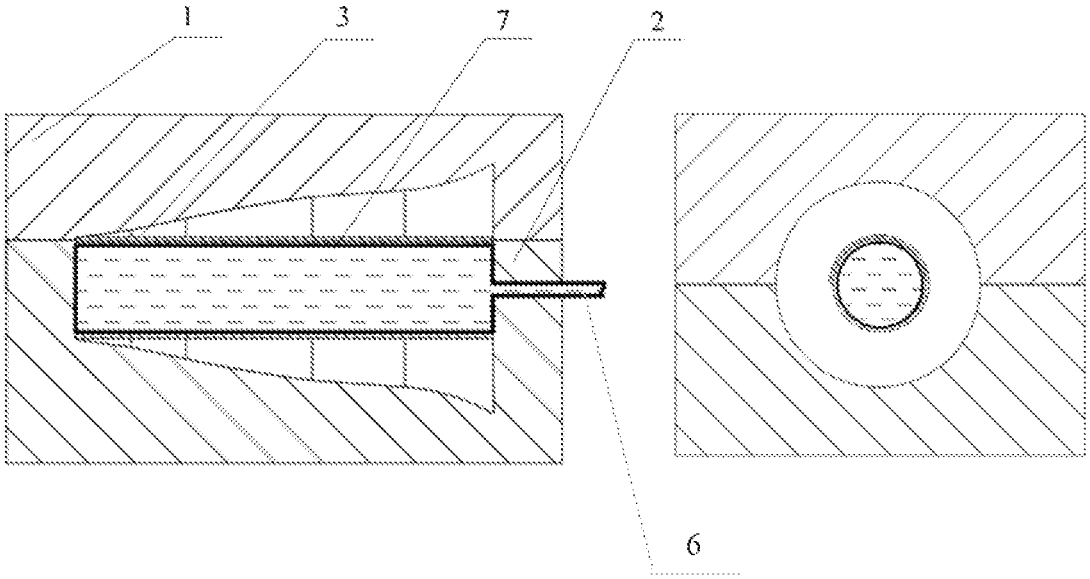
FIG. 3 is a schematic diagram of a positional relationship between a die and a tube blank in a preforming liquid filling stage of the ultra-low pressure liquid filling forming system for a special-shaped component of the present disclosure.
Figure 4:
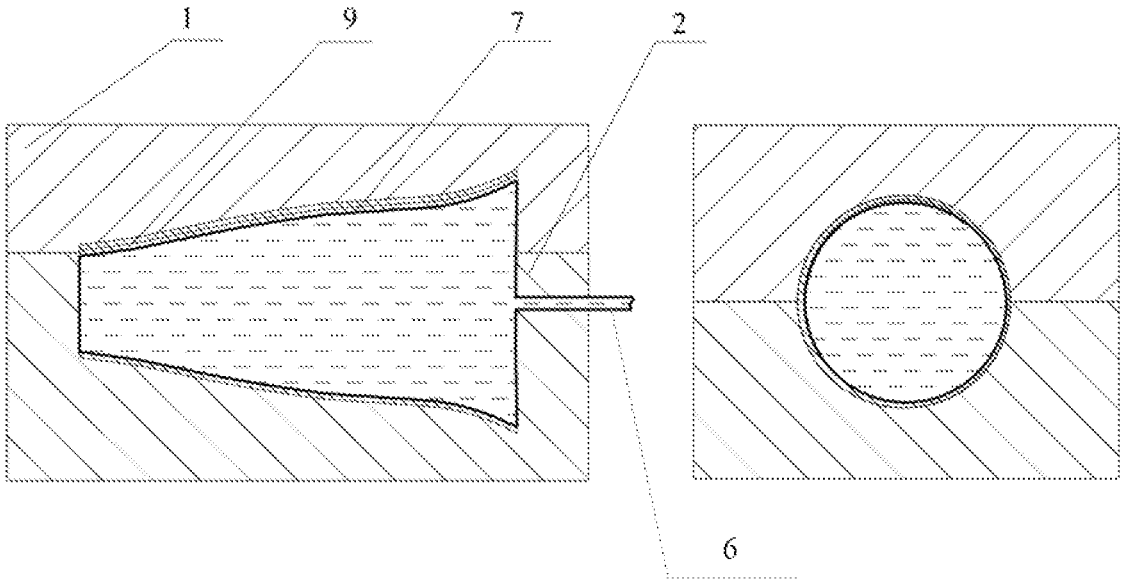
FIG. 4 is a schematic diagram of a positional relationship between a die and a tube blank in a preforming ending stage of the ultra-low pressure liquid filling forming system for a special-shaped component of the present disclosure.
Figure 5:
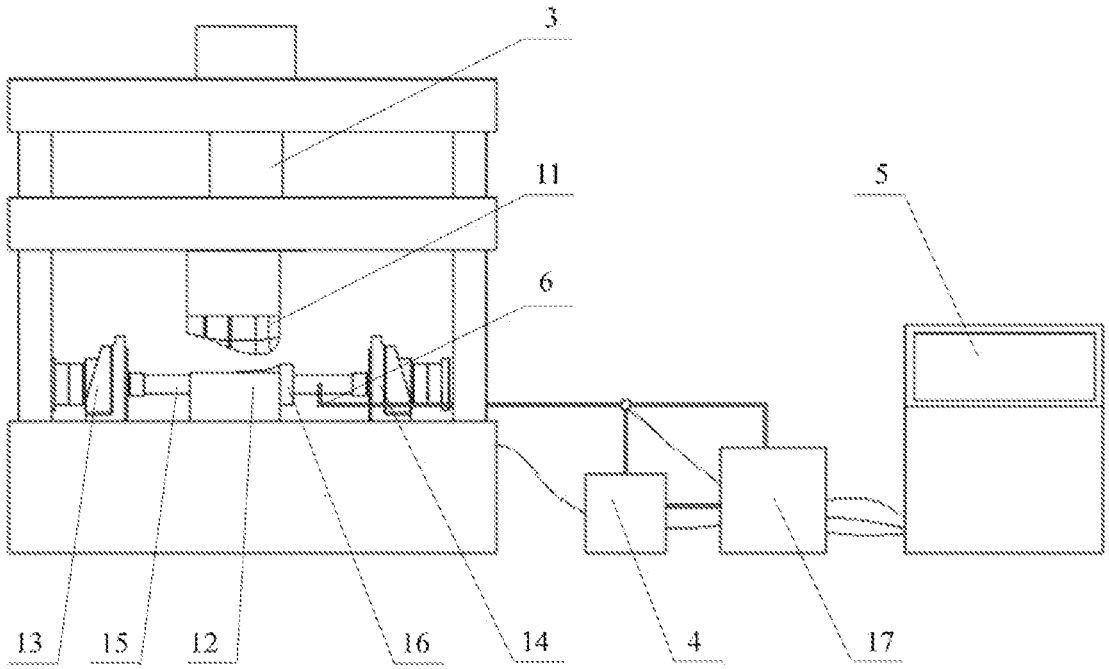
FIG. 5 is a structural schematic diagram of the ultra-low pressure liquid filling forming system for a special-shaped component of the present disclosure.
Figure 6:
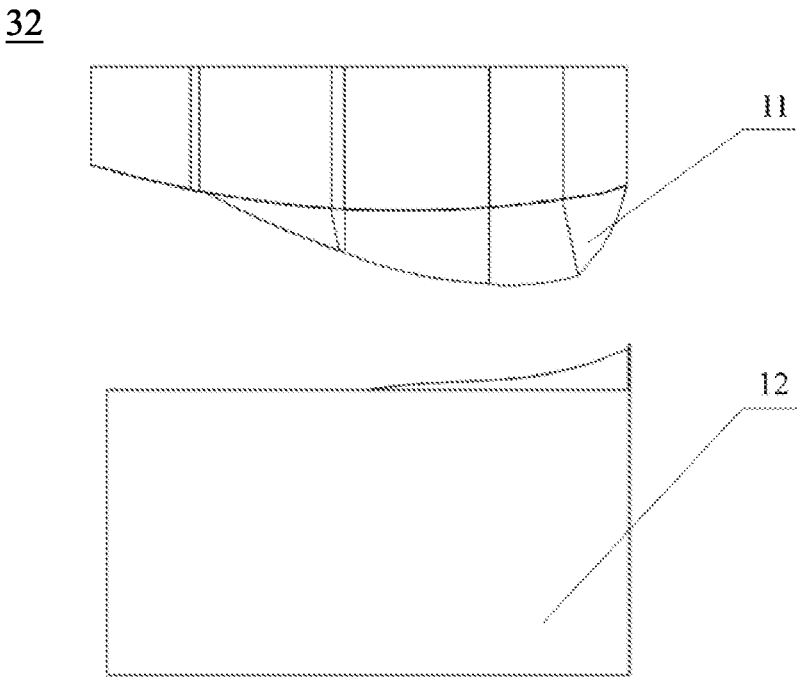
FIG. 6 is a schematic diagram of a shape and a position of a die in a liquid filling press-forming initial stage of the ultra-low pressure liquid filling forming system for a special-shaped component of the present disclosure.
Figure 7:
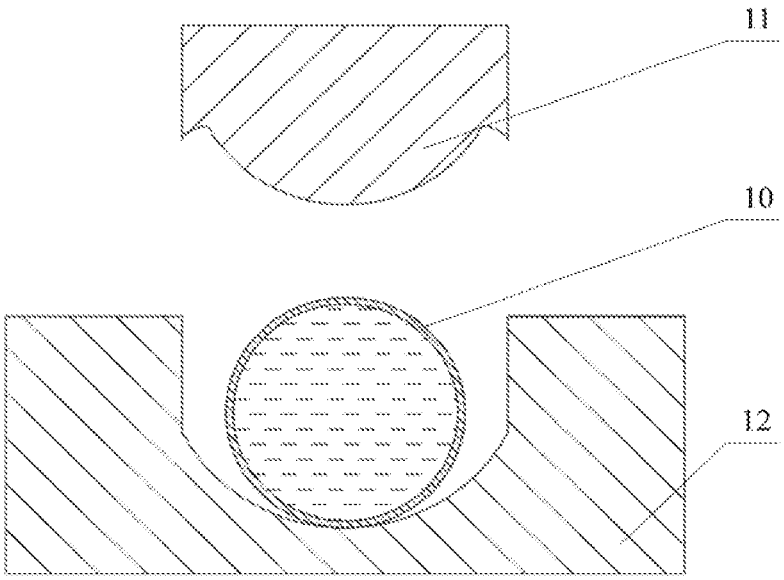
FIG. 7 is a schematic diagram of a shape and a position of a die in a liquid filling press-forming initial stage of the ultra-low pressure liquid filling forming system for a special-shaped component of the present disclosure.
Figure 8:
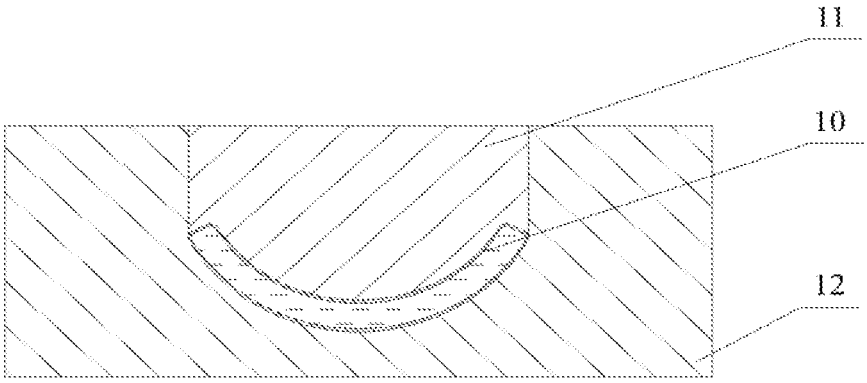
FIG. 8 is a schematic diagram of a positional relationship between a die and a tube blank in a liquid filling press-forming stage of the ultra-low pressure liquid filling forming system for a special-shaped component of the present disclosure.
Figure 9:
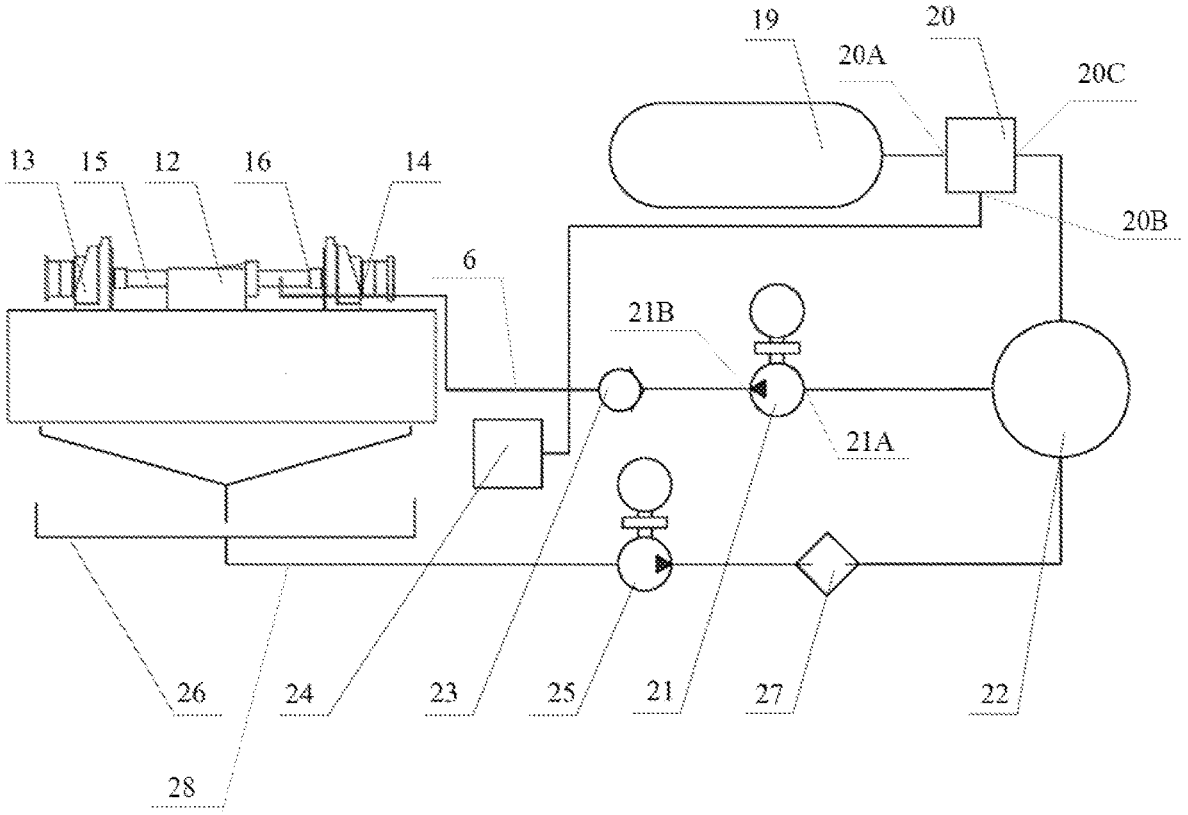
FIG. 9 is a part structural schematic diagram of the ultra-low pressure liquid filling forming system for a special-shaped component of the present disclosure.
Figure 10:
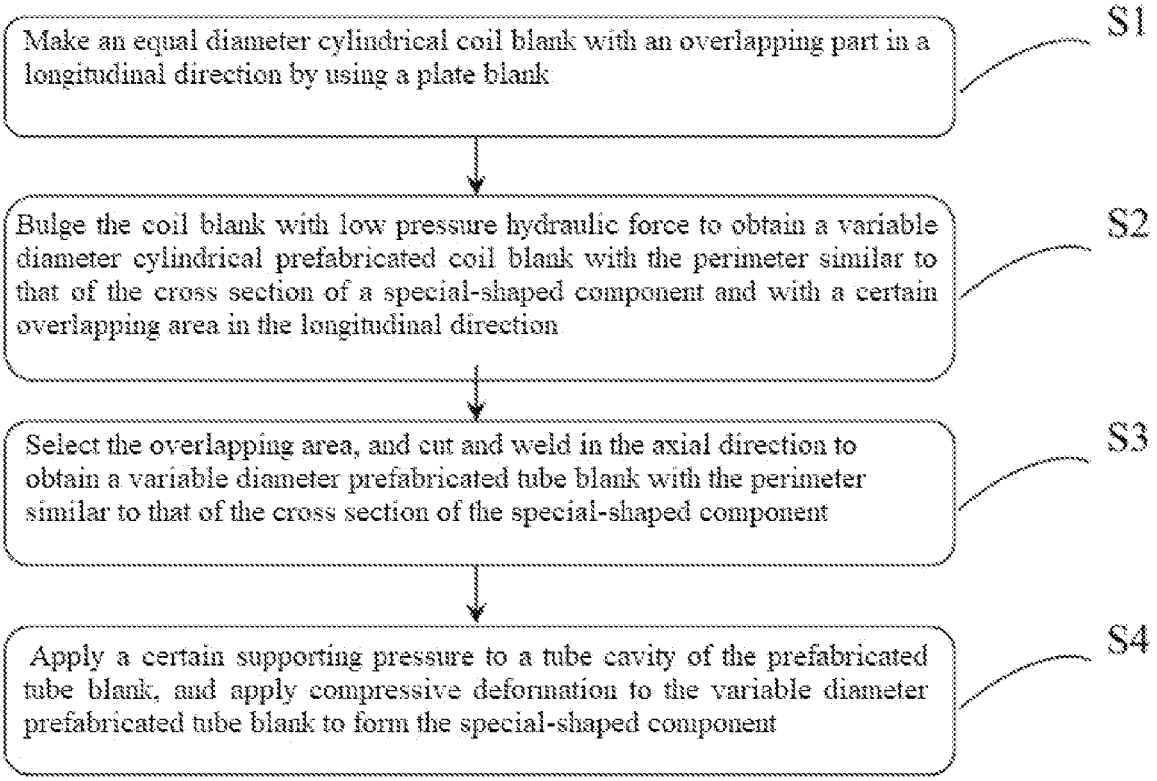
FIG. 10 is a flowchart of an ultra-low pressure liquid filling forming method for a special-shaped component of the present disclosure.
Figure 11:
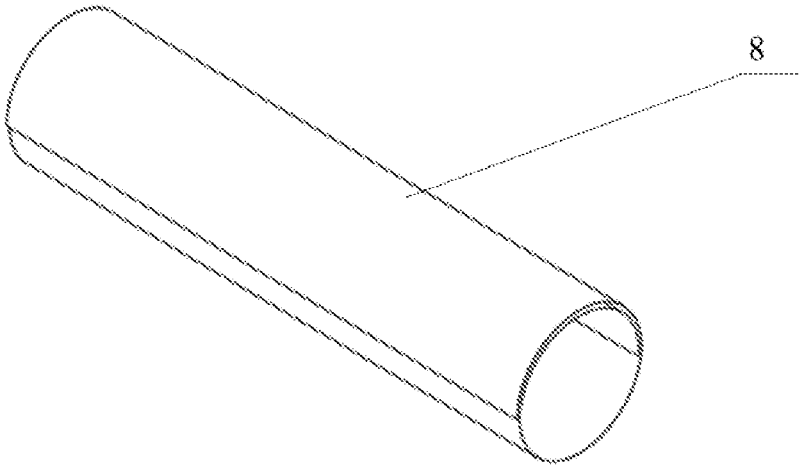
FIG. 11 is an equal diameter cylindrical coil blank provided by the present disclosure.
Figure 12:
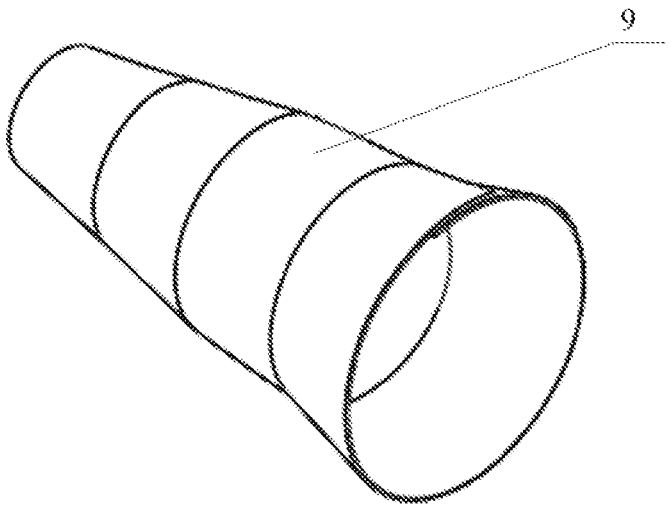
FIG. 12 is a variable diameter cylindrical prefabricated coil blank, with a similar perimeter to that of a cross section of a special-shaped component, of the present disclosure.
Figure 13:
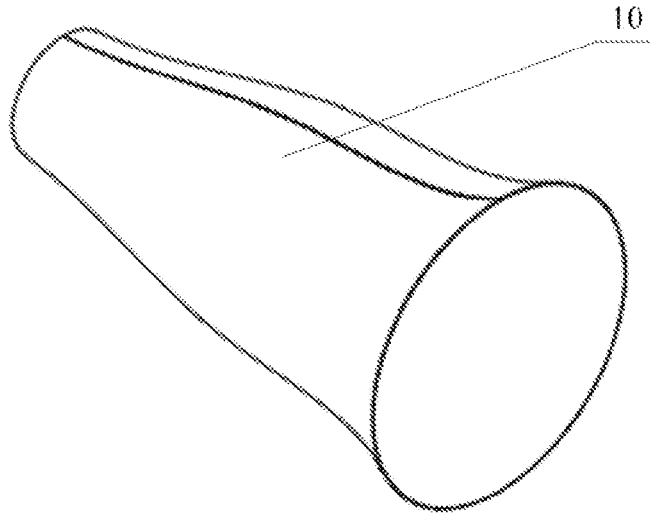
FIG. 13 is a variable diameter prefabricated tube blank, with a similar perimeter to that of a cross section of a special-shaped component, provided by the present disclosure.
Figure 14:
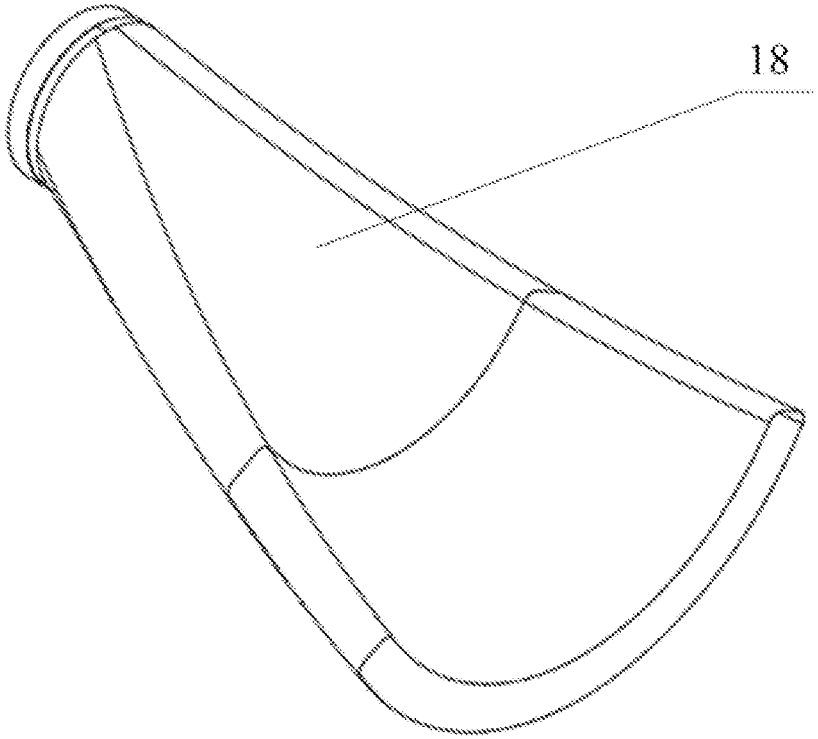
FIG. 14 is a special-shaped component provided by the present disclosure.
Figure 15:
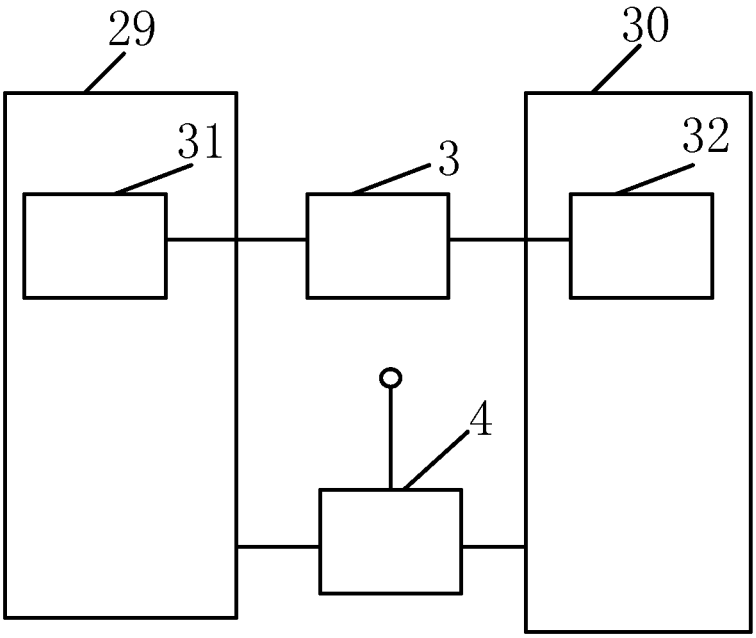
FIG. 15 is a block diagram showing a supercharger being connected to both a preforming unit and a final forming unit, and a driving device being connected to a preforming die and a liquid filling press-forming die.

As shown in FIG. 1 to FIG. 15, the present disclosure provides an ultra-low pressure liquid filling forming system for a special-shaped component 18, which may include a control system 5, a supercharger 4, a driving device 3, a preforming unit 29, and a final forming unit 30. The preforming unit 29 may include a preforming die 31 a self-sealing liquid bag 7. The final forming unit 30 may include a liquid filling press-forming die 32 and two tube end self-sealing devices. The tube end self-sealing device may include a tube end self-sealing punch 15, 16 and an oil cylinder 13, 14 used for driving the tube end self-sealing punch 15, 16. In some embodiments, the tube end self-sealing punch 15, 16 may adopt the existing internal and external restraint-type tube liquid filling pressing sealing device. The specific structure and working principle of the internal and external restraint type tube liquid filling pressing sealing device refers to Chinese Patent Application No. 201911366025.2 titled "internal and external restraint type tube liquid filling pressing sealing device and method." The driving device 3 may drive the preforming die 31 and the liquid filling press-forming die 32 to close and open. The driving device 3 and the supercharger 4 may be separately and electrically connected to the control system 5, where one of the tube end self-sealing punches 15, 16 may be provided with a liquid through pipe 6, and the liquid through pipe 6 and the self-sealing liquid bag 7 may be separately communicated with a liquid outlet of the supercharger 4.

The shape and size of a mold cavity of the preforming die 31 may be matched with the shape and size of a variable diameter cylindrical prefabricated coil blank 9. The shape and size of a mold cavity of the liquid filling press-forming die 32 may be matched with the shape and size of a special-shaped component 18.

A coil blank arranged in the mold cavity of the preforming die 31 may be bulged into a variable diameter cylindrical prefabricated coil blank 9 by filling a high-pressure liquid into the self-sealing liquid bag 7 through the supercharger 4. The high-pressure liquid may be filled into the variable diameter cylindrical prefabricated coil blank 9 arranged in the mold cavity of the filling press-forming die through the supercharger 4 and the liquid through pipe 6.

The ultra-low pressure liquid filling forming system for a special-shaped component 18 of the present embodiment may further include a recovery unit. The recovery unit may include a sedimentation tank 26, a liquid recovery pump 25, a filter 27, a water tank 22, and a safety valve. The sedimentation tank 26 may be arranged below the liquid filling press-forming die 32. The liquid overflowing from the liquid filling press-forming die 32 may flow into the sedimentation tank 26. The sedimentation tank 26 may be in communication with the water tank 22 through a connecting pipe 28. The liquid recovery pump 25 and the filter 27 may be separately arranged on the connecting pipe 28, and the filter 27 may be closer to the water tank 22 than the liquid recovery pump 25.

The ultra-low pressure liquid filling forming system for a special-shaped component 18 of the present disclosure may further include a constant pressure unit 17. The constant pressure unit 17 may include an energy accumulator 19, a three-way valve 20, a liquid inlet hydraulic pump 21, a one-way valve 23, and a pressure sensor 24 arranged in the supercharger 4 that may be separately and electrically connected to the control system. A liquid inlet 21A of the liquid inlet hydraulic pump 21 may be in communication with the water tank 22. A liquid outlet 21B of the liquid inlet hydraulic pump 21 may be in communication with the supercharger 4. The one-way valve 23 may be arranged on a pipeline between the liquid inlet hydraulic pump 21 and the supercharger 4. A first end 20A of the three-way valve 20 may be in communication with the energy accumulator 19. A second end 20B of the three-way valve 20 may be in communication with a pipeline between the one-way valve 23 and the supercharger 4. A third end 20C of the three-way valve 23 may be in communication with the water tank 22.

Working processes of the constant pressure unit 17 and the recovery unit are as follows:

(1) Liquid filling supercharging process: the liquid inlet hydraulic pump 21 is started, sucks a liquid medium from the water tank 22, and fills the liquid medium into a variable diameter prefabricated tube blank 10 through the one-way valve 23 and a liquid through pipe 6 in a right tube end self-sealing punch 16 in sequence. When it is detected that the liquid chamber pressure introduced into the variable diameter prefabricated tube blank 10 exceeds a set value through the pressure sensor 24, the liquid inlet hydraulic pump 21 may be shut down to stop filling the liquid into the variable diameter prefabricated tube blank 10.

(2) Constant pressure process: the pressure of nitrogen inside the energy accumulator 19 is adjusted to a set pressure p , and the three-way valve 20 acts so that the energy accumulator 19 is put into work. In a liquid filling press-forming process, the volume of the variable diameter prefabricated tube blank 10 is decreased gradually so that the internal pressure is increased. The liquid chamber pressure introduced into the variable diameter prefabricated tube blank 10 may be detected through the pressure sensor 24. At this time, the liquid medium enters the energy accumulator 19 to ensure that the liquid chamber pressure of the variable diameter prefabricated tube blank 10 is constant at p.

(3) Liquid recovery process: after forming is ended, the three-way valve 20 may be reset, and the energy accumulator 19 may be out of operation. A left tube end self-sealing punch 15 and the right tube end self-sealing punch 16 may be withdrawn, and the internal supporting pressure force of the special-shaped component 18 may be zero. The liquid medium may be collected into the sedimentation tank 26, and the liquid recovery pump 25 may be started so that the liquid in the sedimentation tank 26 may be recovered into the water tank 22 through the filter 27.

The present disclosure further provides an ultra-low pressure liquid filling forming method for a special-shaped component 18, based on the ultra-low pressure liquid filling forming system for a special-shaped component. The method may include the following steps:

S1: An equal diameter cylindrical coil blank 8 with an overlapping part in the longitudinal direction may be made by using a plate blank, and two ends of the plate blank may be overlapped at the overlapping part.

The special-shaped component 18 needing to be formed may be unfolded by using numerical simulation software. The shape and size of the required plate blank may be determined according to the shape and size of the unfolded special-shaped component 18, and then the plate blank may be made into the equal diameter cylindrical coil blank 8 through a bending forming process.

S2: The equal diameter cylindrical coil blank 8 may be arranged in the mold cavity of the preforming die 31. The equal diameter cylindrical coil blank 8 may be bulged through a self-sealing liquid bag 7 with low pressure hydraulic force, and the equal diameter cylindrical coil blank 8 may be deformed into a variable diameter cylindrical prefabricated coil blank 9, where the perimeter of the variable diameter cylindrical prefabricated coil blank 9 may be equal to that of the cross section of the special-shaped component 18.

The equal diameter cylindrical coil blank 8 may be placed in a lower die 2 of the preforming die 31. The self-sealing liquid bag 7 may be arranged in the equal diameter cylindrical coil blank 8. Two ends of the equal diameter cylindrical coil blank 8 may be axially limited through baffle plates at two ends of the lower die 2 of the preforming die 31, and an upper die 1 of the preforming die 31 may be driven to move downwards through the driving device 3 so that the preforming die 31 may be closed. The driving device 3 may be controlled, through the control system 5, to apply a proper die closing force to the preforming die 31. A liquid medium may be introduced into the self-sealing liquid bag 7 through the supercharger 4. The supercharger 4 may be controlled to gradually increase the pressure inside the self-sealing liquid bag 7 and ensure that the applied pressure is lower than the yield pressure ps of the equal diameter cylindrical coil blank 8, but is enough to overcome the frictional force between adjacent plate blanks at the overlapping part of the equal diameter cylindrical coil blank 8. Then, the overlapping part of the equal diameter cylindrical coil blank 8 may be unfolded along with the expansive deformation of the self-sealing liquid bag 7. Finally, the variable diameter cylindrical prefabricated coil blank 9 may be obtained.

S3: The overlapping part remaining on the variable diameter cylindrical prefabricated coil blank 9 may be cut and welded in the axial direction to obtain a variable diameter prefabricated tube blank 10 with the perimeter equal to that of the cross section of the special-shaped component 18.

The overlapping part remaining on the variable diameter cylindrical prefabricated coil blank 9 may be cut from an upper layer and a lower layer, a leftover material of the overlapping part may be removed, and welding may be performed along a cutting line.

S4: The variable diameter prefabricated tube blank 10 may be arranged in the mold cavity of the liquid filling press-forming die 32. A high-pressure liquid may be filled into the tube cavity of the variable diameter prefabricated tube blank 10 through the supercharger 4 to apply a supporting force to the tube cavity, and then compressive deformation may be applied to the variable diameter prefabricated tube blank 10 through the liquid filling press-forming die 32 so as to form the special-shaped component 18.

The variable diameter prefabricated tube blank 10 may be placed in a lower die 12 of the liquid filling press-forming die 32. The control system 5 may control the left oil cylinder 13 to drive the left self-sealing punch 15 to move inwards along the variable diameter prefabricated tube blank 10, and control the right oil cylinder 14 to drive the right self-sealing punch 16 to move inwards along the variable diameter prefabricated tube blank 10, so as to seal the two ends of the variable diameter prefabricated tube blank 10. A high-pressure liquid may be introduced into the variable diameter prefabricated tube blank 10 through the supercharger 4 and the liquid through pipe 6, and the applied pressure may be ensured to be lower than the yield pressure ps of the variable diameter prefabricated tube blank 10. Then, the driving device 3 may be controlled, through the control system 5, to drive the upper die 11 of the liquid filling press-forming die 32 to move downwards to close the liquid filling press-forming die 32. During the process, the pressure of the liquid in the variable diameter prefabricated tube blank 10 may be unchanged, and the variable diameter prefabricated tube blank 10 may be pressed into the mold cavity of the liquid filling press-forming die 32 under the pressing action of the upper die 11 of the liquid filling press-forming die 32 and the supporting action of the high-pressure liquid in the variable diameter prefabricated tube blank 10. The variable diameter prefabricated tube blank 10 may be pressed continuously after completely filling the mold cavity of the liquid filling press-forming die 32 so that the variable diameter prefabricated tube blank 10 experiences compressive deformation along the circumferential direction. During the process, the perimeter of the variable diameter prefabricated tube blank 10 may be decreased and the wall thickness may be increased. Finally, the special-shaped component 18 may be obtained.

The yield pressure in S2 and S4 may be determined by using the formula: $P_s=t/r\sigma_s$, where t is the wall thickness of a tube, $\sigma_s$ is the material yield strength of the tube blank, and r is the minimum radius of a circular cross section of a target coil blank.

Taking the process in which a stainless-steel material (e.g., 06Cr19Ni10) serves as the equal diameter cylindrical coil blank 8 as an example, the initial wall thickness may be 1.0 mm. At room temperature, the stainless-steel may have an elastic modulus of 208 GPa, a yield strength of 287 MPa, a tensile strength of 803 MPa, and a maximum elongation before fracture of 52.6%. The end surface of one side of the formed special-shaped component 18 may have a φ140 circular cross section, and may gradually be changed into a crescent-shaped cross section at the right end. The height of a mold cavity of the crescent-shaped cross section may be 40 mm, the maximum width may be 510 mm, the perimeter difference of the cross sections may reach over three times, the total length of the formed piece may be 600 mm, the radius of the minimum fillet located at a side wall fillet may be 12 mm, the upper surface and the lower surface may be respectively concave and convex hyperbolic surfaces, and the axis may be curved. If the conventional internal high pressure forming method is adopted, a conical tube blank needs to be used for forming. The maximum diameters of the two ends of the tube blank may be 110 mm and 350 mm, respectively, under the condition of no compression instability. In an internal high pressure forming process, the tube blank may be completely attached to a mold cavity of a die only when the forming pressure is higher than 50 MPa, and the maximum wall thickness thinning rate of the obtained formed piece may be up to 36.8%. By adopting the special-shaped component 18 forming method of the present disclosure, first, a flat plate of which the perimeters of the two ends may be 450 mm and 1300 mm, respectively, may be curved into the equal diameter cylindrical coil blank 8, where its length and initial diameter may be 600 mm and 140 mm, respectively. During a low-hydraulic force bulging process of the coil blank, the maximum pressure inside the liquid bag may be 2.0 MPa, and the variable diameter prefabricated tube blank 10 of which the diameters of the two ends may be 140 mm and 425 mm, respectively, may be obtained after the variable diameter cylindrical prefabricated coil blank 9 obtained after forming is subjected to cutting and welding processes. Finally, a final target piece may be formed through a liquid filling press-forming process. During the whole die closing process, the supporting pressure of the tube blank may be constant at 2.0 MPa. After forming, the tube blank may be completely attached to the mold cavity of the die to obtain the special-shaped component 18. The maximum wall thickness thinning rate of the special-shaped component 18 may occur at a fillet transition area of only 3.1%. Compared with the internal high pressure forming process, the forming pressure may be reduced by 96%, and the maximum wall thickness thinning rate may be reduced by 91.6%. Therefore, by adopting the ultra-low pressure liquid filling forming method for the special-shaped component 18, the pressure may be remarkably reduced, and the wall thickness distribution may be improved.

The method in the present disclosure may solve the existing technical problems of forming a special-shaped thin-walled component, namely that a variety of improvement methods proposed based on an "expansive deformation idea" cannot meet the overall forming requirements of the special-shaped thin-walled components with large diameter-to-thickness ratios, large sectional difference and high-precision. A high-strength special-shaped thin-walled component with high precision and high performance may be obtained by bulging the equal diameter cylindrical coil blank 8 through the self-sealing liquid bag 7 and pre-distributing a material in the circumferential direction to obtain a variable diameter prefabricated tube blank 10 with the perimeter similar to that of the cross section of the special-shaped component 18, and then performing press-forming on the variable diameter prefabricated tube blank 10 under the supporting of internal pressure.

In the description of the present disclosure, it should be noted that the terms "center", "top", "bottom", "left", "right", "vertical", "horizontal", "inside", "outside" and the like are orientations or positional relationships shown in the accompanying drawings, and are merely for the convenience of describing the present disclosure and simplifying the description, rather than indicating or implying that the devices or elements referred to must have particular orientations, and be configured and operated at the particular orientations. Thus, it cannot be construed as a limitation to the scope of protection of the present disclosure. In addition, terms "first", "second" are merely used for description, and cannot be construed as indicating or implying relative importance.

In the present disclosure, specific examples are applied to illustrate the principle and implementation manners of the present disclosure. The description of the above embodiments is merely used to help understand the method and its core idea of the present disclosure. Meanwhile, for those of ordinary skill in the art, there will be changes in the specific implementation manners and scope of application according to the idea of the present disclosure. In conclusion, the contents of the present specification shall not be construed as a limitation to the present disclosure.

What is claimed is:

1. An ultra-low pressure liquid filling forming system for a special-shaped component, comprising:

a control system;

a preforming unit comprising a preforming die and a self-sealing liquid bag;

a supercharger having a liquid outlet and electrically connected to the control system, wherein the liquid outlet is connected to the self-sealing liquid bag;

a final forming unit comprising a liquid filling press-forming die and two tube end self-sealing devices, wherein each of the tube end self-sealing devices comprises:

a tube end self-sealing punch; and an oil cylinder used for driving the tube end self-sealing punch, wherein one of the tube end self-sealing punches is provided with a liquid through pipe, the liquid through pipe is connected to the liquid outlet; and a driving device electrically connected to the control system, wherein the driving device can drive the preforming die and the liquid filling press-forming die between an open position and a closed position.

2. The ultra-low pressure liquid filling forming system for a special-shaped component of claim 1, wherein a shape and size of a mold cavity of the preforming die are matched with a shape and size of a variable diameter cylindrical prefabricated coil blank, wherein a shape and size of a mold cavity of the liquid filling press-forming die is further matched with the shape and size of the special-shaped component.

3. The ultra-low pressure liquid filling forming system for a special-shaped component of claim 1, wherein a mold cavity of the preforming die is arranged with a coil blank; the supercharger is configured to fill a high-pressure liquid into the self-sealing liquid bag to bulge the coil blank into a variable diameter cylindrical prefabricated coil blank, wherein the high-pressure liquid is filled into the variable diameter cylindrical prefabricated coil blank arranged in a mold cavity of the liquid filling press-forming die through the supercharger and the liquid through pipe.

4. The ultra-low pressure liquid filling forming system for a special-shaped component of claim 1, further comprising a recovery unit, wherein the recovery unit comprises:

a sedimentation tank arranged below the liquid filling press-forming die, wherein a liquid overflowing from the liquid filling press-forming die flows into the sedimentation tank;

a water tank connected to the sedimentation tank through a connecting pipe;

a liquid recovery pump and a filter separately arranged on the connecting pipe, wherein the filter is closer to the water tank than the liquid recovery pump; and a safety valve.

5. The ultra-low pressure liquid filling forming system for a special-shaped component of claim 4, further comprising a constant pressure unit, wherein the constant pressure unit comprises:

an energy accumulator;

a liquid inlet of a liquid inlet hydraulic pump connected to the water tank;

a liquid outlet of the liquid inlet hydraulic pump connected to the supercharger;

a one-way valve arranged on a pipeline between the liquid inlet hydraulic pump and the supercharger;

a pressure sensor arranged in the supercharger that is separately and electrically connected to the control system; and a three-way valve having a first end, a second end, and a third end, wherein the first end is connected to the energy accumulator, the second end is connected to a pipeline between the one-way valve and the supercharger, and the third end is connected to the water tank.

6. An ultra-low pressure liquid filling forming method for a special-shaped component comprising the following steps:

S1: making an equal diameter cylindrical coil blank with an overlapping part in a longitudinal direction by using a plate blank, wherein two ends of the plate blank are overlapped at an overlapping part;

S2: arranging the equal diameter cylindrical coil blank in a mold cavity of a preforming die, bulging the equal diameter cylindrical coil blank through a self-sealing liquid bag with low pressure hydraulic force, and making the equal diameter cylindrical coil blank deform into a variable diameter cylindrical prefabricated coil blank, wherein the perimeter of the variable diameter cylindrical prefabricated coil blank is equal to that of the cross section of the special-shaped component;

S3: cutting and welding the overlapping part remaining on the variable diameter cylindrical prefabricated coil blank in an axial direction to obtain a variable diameter prefabricated tube blank with a perimeter equal to that of the cross section of the special-shaped component; and S4: arranging the variable diameter prefabricated tube blank in a mold cavity of a liquid filling press-forming die, filling a high-pressure liquid into the tube cavity of the variable diameter prefabricated tube blank through a supercharger to apply a supporting force to the tube cavity, and applying compressive deformation to the variable diameter prefabricated tube blank through the liquid filling press-forming die, so as to form the special-shaped component.

7. The ultra-low pressure liquid filling forming method for a special-shaped component of claim 6, wherein the shape and size of the mold cavity of the preforming die are matched with the shape and size of a variable diameter cylindrical prefabricated coil blank, wherein the shape and size of the mold cavity of the liquid filling press-forming die are matched with the shape and size of the special-shaped component.

8. The ultra-low pressure liquid filling forming method for a special-shaped component of claim 7, wherein in S1, the special-shaped component needing to be formed is unfolded by using numerical simulation software, the shape and size of the required plate blank are determined according to the shape and size of the unfolded special-shaped component, and the plate blank is made into the equal diameter cylindrical coil blank through a bending forming process.

9. The ultra-low pressure liquid filling forming method for a special-shaped component of claim 7, wherein in S2:

the equal diameter cylindrical coil blank is placed in a lower die of the preforming die;

the self-sealing liquid bag is arranged in the equal diameter cylindrical coil blank;

two ends of the equal diameter cylindrical coil blank are axially limited through baffle plates at two ends of the lower die of the preforming die;

an upper die of the preforming die is driven to move downwards through a driving device so that the preforming die is closed;

the driving device is controlled, through a control system, to apply a proper die closing force to the preforming die;

a liquid medium is introduced into the self-sealing liquid bag through the supercharger;

the supercharger is controlled to gradually increase the pressure inside the self-sealing liquid bag and ensure that the applied pressure is lower than the yield pressure of the equal diameter cylindrical coil blank but is enough to overcome the frictional force between adjacent plate blanks at the overlapping part of the equal diameter cylindrical coil blank;

the overlapping part of the equal diameter cylindrical coil blank is unfolded along with the expansive deformation of the self-sealing liquid bag; and the variable diameter cylindrical prefabricated coil blank is obtained.

10. The ultra-low pressure liquid filling forming method for a special-shaped component of claim 6, wherein the equal diameter cylindrical coil blank arranged in the mold cavity of the preforming die is bulged into the variable diameter cylindrical prefabricated coil blank by filling a high-pressure liquid into the self-sealing liquid bag through the supercharger, wherein the high-pressure liquid can be filled into the variable diameter cylindrical prefabricated coil blank arranged in the mold cavity of the liquid filling press-forming die through the supercharger and a liquid through pipe.

11. The ultra-low pressure liquid filling forming method for a special-shaped component of claim 10, wherein in S1, the special-shaped component needing to be formed is unfolded using numerical simulation software, the shape and size of the required plate blank are determined according to the shape and size of the unfolded special-shaped component, and then making the plate blank into the equal diameter cylindrical coil blank through a bending forming process.

12. The ultra-low pressure liquid filling forming method for a special-shaped component of claim 10, wherein in S2:

the equal diameter cylindrical coil blank is placed in a lower die of the preforming die;

the self-sealing liquid bag is arranged in the equal diameter cylindrical coil blank;

two ends of the equal diameter cylindrical coil blank are axially limited through baffle plates at two ends of the lower die of the preforming die;

an upper die of the preforming die is driven to move downwards through a driving device so that the preforming die is closed;

the driving device is controlled, through a control system, to apply a proper die closing force to the preforming die;

a liquid medium is introduced into the self-sealing liquid bag through the supercharger;

the supercharger is controlled to gradually increase the pressure inside the self-sealing liquid bag and ensure that the applied pressure is lower than the yield pressure of the equal diameter cylindrical coil blank but is enough to overcome the frictional force between adjacent plate blanks at the overlapping part of the equal diameter cylindrical coil blank;

the overlapping part of the equal diameter cylindrical coil blank is unfolded along with the expansive deformation of the self-sealing liquid bag; and the variable diameter cylindrical prefabricated coil blank is obtained.

13. The ultra-low pressure liquid filling forming method for a special-shaped component of claim 6, further comprising a recovery unit, wherein the recovery unit comprises:

a water tank;

a sedimentation tank arranged below the liquid filling press-forming die and connected to the water tank through a connecting pipe, wherein a liquid overflowing from the liquid filling press-forming die flows into the sedimentation tank;

a liquid recovery pump and a filter separately arranged on the connecting pipe wherein the filter is closer to the water tank than the liquid recovery pump; and a safety valve.

14. The ultra-low pressure liquid filling forming method for a special-shaped component of claim 13, further comprising a constant pressure unit, wherein the constant pressure unit comprises:

an energy accumulator;

a liquid inlet of a liquid inlet hydraulic pump connected to the water tank;

a liquid outlet of the liquid inlet hydraulic pump connected to the supercharger;

a one-way valve arranged on a pipeline between the liquid inlet hydraulic pump and the supercharger;

a pressure sensor arranged in the supercharger that is separately and electrically connected to the control system; and a three-way valve having a first end, a second end, and a third end, wherein the first end is connected to the energy accumulator, the second end is connected to a pipeline between the one-way valve and the supercharger, and the third end is connected to the water tank.

15. The ultra-low pressure liquid filling forming method for a special-shaped component according to claim 14, wherein in S1, the special-shaped component needing to be formed is unfolded using numerical simulation software, the shape and size of the required plate blank are determined according to the special-shaped component, and the plate blank is made into the equal diameter cylindrical coil blank through a bending forming process.

16. The ultra-low pressure liquid filling forming method for a special-shaped component of claim 13, wherein in S1, the special-shaped component needing to be formed is unfolded using numerical simulation software, the shape and size of the required plate blank are determined according to the shape and size of the unfolded special-shaped component, and the plate blank is made into the equal diameter cylindrical coil blank through a bending forming process.

17. The ultra-low pressure liquid filling forming method for a special-shaped component of claim 6, wherein in S1, the special-shaped component to be formed is unfolded using numerical simulation software, the shape and size of the required plate blank are determined according to the shape and size of the unfolded special-shaped component, and the plate blank is made into the equal diameter cylindrical coil blank through a bending forming process.

18. The ultra-low pressure liquid filling forming method for a special-shaped component of claim 6, wherein in S2:

the equal diameter cylindrical coil blank is placed in a lower die of the preforming die;

the self-sealing liquid bag is arranged in the equal diameter cylindrical coil blank;

two ends of the equal diameter cylindrical coil blank are axially limited through baffle plates at two ends of the lower die of the preforming die;

an upper die of the preforming die is driven to move downwards through a driving device so that the preforming die is closed;

the driving device is controlled, through a control system, to apply a proper die closing force to the preforming die;

a liquid medium is introduced into the self-sealing liquid bag through the supercharger;

the supercharger is controlled to gradually increase the pressure inside the self-sealing liquid bag and ensure that the applied pressure is lower than the yield pressure of the equal diameter cylindrical coil blank but is enough to overcome the frictional force between adjacent plate blanks at the overlapping part of the equal diameter cylindrical coil blank;

the overlapping part of the equal diameter cylindrical coil blank is unfolded along with the expansive deformation of the self-sealing liquid bag; and the variable diameter cylindrical prefabricated coil blank is obtained.

19. The ultra-low pressure liquid filling forming method for a special-shaped component of claim 6, wherein in S3:

the overlapping part remaining on the variable diameter cylindrical prefabricated coil blank is cut at one time from an upper layer and a lower layer;

a leftover material of the overlapping part is removed; and welding is performed along a cutting line.

20. The ultra-low pressure liquid filling forming method for a special-shaped component of claim 6, wherein in S4:

the variable diameter prefabricated tube blank is placed in a lower die of the liquid filling press-forming die;

two oil cylinders are controlled, through a control system, to drive corresponding self-sealing punches to move inwards along the variable diameter prefabricated tube blank so as to seal the two ends of the variable diameter prefabricated tube blank;

the high-pressure liquid is introduced into the variable diameter prefabricated tube blank through the supercharger and the liquid through pipe, wherein the applied pressure is ensured to be lower than the yield pressure of the variable diameter prefabricated tube blank;

a driving device is controlled, through the control system, to drive an upper die of the liquid filling press-forming die, wherein during the process, the pressure of the liquid in the variable diameter prefabricated tube blank is ensured to be unchanged;

the variable diameter prefabricated tube blank is pressed into a the mold cavity of the liquid filling press-forming die under the pressing action of the upper die of the liquid filling press-forming die and the supporting action of the high-pressure liquid in the variable diameter prefabricated tube blank;

the variable diameter prefabricated tube blank is pressed continuously after completely filling the mold cavity of the liquid filling press-forming die so that the variable diameter prefabricated tube blank occurs compressive deformation along the circumferential direction, wherein the perimeter of the variable diameter prefabricated tube blank is decreased and the wall thickness is increased; and the special-shaped component is obtained.

* * * * *